US007299000B2

(12) United States Patent
Taira et al.

(10) Patent No.: US 7,299,000 B2
(45) Date of Patent: Nov. 20, 2007

(54) IMAGE FORMING APPARATUS HAVING A RECORDING MATERIAL TRANSPORTING PATH

(75) Inventors: Seiji Taira, Ebina (JP); Kenji Hara, Ebina (JP); Keiji Miba, Ebina (JP); Yoshiaki Tainaka, Ebina (JP); Yumiko Onuma, Ebina (JP); Keiichiro Sato, Ebina (JP); Noriyuki Miyoshi, Ebina (JP); Masakatsu Eda, Ebina (JP); Keita Yano, Ebina (JP); Tomofumi Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 11/118,412

(22) Filed: May 2, 2005

(65) Prior Publication Data

US 2006/0092258 A1 May 4, 2006

(30) Foreign Application Priority Data

Nov. 4, 2004 (JP) ..... 2004-320500

(51) Int. Cl.
*G03G 15/20* (2006.01)

(52) U.S. Cl. ..... 399/322

(58) Field of Classification Search ..... 399/322, 399/323, 328

See application file for complete search history.

(56) References Cited

U.S. PATENT DOCUMENTS

| | | | | |
|---|---|---|---|---|
| 6,259,881 | B1 * | 7/2001 | Nakamura | 399/323 |
| 7,118,843 | B2 * | 10/2006 | Teshima | 399/328 |
| 7,149,463 | B2 * | 12/2006 | Fujisawa et al. | 399/323 |

FOREIGN PATENT DOCUMENTS

| | | |
|---|---|---|
| JP | 2003-195668 | 7/2003 |
| JP | 2004-233405 | 8/2004 |

* cited by examiner

*Primary Examiner*—William J. Royer
(74) *Attorney, Agent, or Firm*—Morgan, Lewis & Bockius

(57) ABSTRACT

An image forming apparatus includes a recording material transporting path that extends in a direction from bottom to top of a body of the image forming apparatus and transports a recording material, a fixing device provided on the recording material transporting path, which includes a rotatable heating member that has an internal heat source and a rotatable pressure member that forms a nip area with the heating member by being located in contact with and pressed against the heating member, to nip the recording material for carrying out a fixing process, and an ejection guide member that guides a recording material ejected from the nip area to the outside of the image forming apparatus. The ejection guide member has a guide surface formed to intersect a tangent line of the heating member at the most downstream point of the nip area, and the guide surface intersects the tangent line at an obtuse angle.

11 Claims, 7 Drawing Sheets

IMAGE FORMING APPARATUS HAVING A RECORDING MATERIAL TRANSPORTING PATH

BACKGROUND OF THE INVENTION

1. Field of the Invention

The present invention relates to image forming apparatus using, for example, an electrophotographic process, and more particularly, to an image forming apparatus that forms an image on a recording material, while transporting the recording material in an approximately vertical direction.

2. Description of the Related Art

In an electrophotographic image forming apparatus such as copiers and printers, by evenly charging a photoreceptor, for example, formed in a drum-like shape (photoreceptor drum) and exposing the photoreceptor drum to light controlled, based on image information, an electrostatic latent image is formed on the photoreceptor drum. Then, by applying toner to the electrostatic latent image, a visible image (applied toner image) is developed. After a transfer unit transfers this applied toner image from the surface of the photoreceptor drum onto a recording material, a fixing device fixes the toner image to the recording material.

The fixing device for use in such an image forming apparatus is generally a combination of a fusing roller and a pressure roller pressed against each other. The fusing roller is made up of a cylindrical metal core member with an internal heat source and multiple layers formed surrounding the core including an elastic body layer and a release layer which are thermally resistive. The pressure roller is made up of a metal core member and multiple layers formed surrounding the core including a heat-resistive elastic body layer and a release layer made up of a heat-resistive resin film or a rubber film. In this configuration of the fixing device, the recording material carrying an unfixed toner image is allowed to pass between the rotating fusing roller and pressure roller. At this time, the unfixed toner image is heated and pressurized and thereby fixed to the recording material.

A configuration of the image forming apparatus is known in which the above fixing device is located vertically above the photoreceptor drum, a transport path is formed to transport the recording material supplied from a paper tray located vertically below the photoreceptor drum upward in an approximately vertical direction, the transfer unit located along the transport path transfers the toner image on the photoreceptor drum to the recording material, and the recording material is transported to the fixing device.

The image forming apparatus having this configuration features a very short transport path of the recording material and a most part of the transport path can be exposed only by opening one side of the apparatus. Thus, the image forming time from paper feed to paper ejection can be shortened and the recording material can be transported more readily. In the event of a paper jam, the jammed recording material can be removed more easily. Moreover, another merit is that the image forming apparatus can be designed to be installed in a smaller area.

However, in the image forming apparatus that transports the recording material upward in the approximately vertical direction (vertical transport), because the fixing device is located on the recording material transport path from down to up against the force of gravity, when the recording material is transported after the toner image has been fixed to it at the fixing device, the gravity is exerted on the recording material being ejected from the fixing device in an opposite direction on approximately the same line as the transport direction. For this reason, unlike a conventional image forming apparatus that transports the recording material horizontally, for the image forming apparatus with the vertical transport path, it is difficult to provide a stable support of the recording material being transported, utilizing the force of gravity, and the behavior of the recording material is liable to become unstable. Because of difficulty of stable support in the horizontal direction of the recording material being transported upward in the approximately vertical direction, nipped between and driven by the fusing roller and the pressure roller rotating, pressed against each other, the recording material becomes unstable in the horizontal direction. Consequently, the recording material may move in variable directions while being transported and wave-like flexure (so-called "paper cockle") toward the forward direction is liable to occur in the recording material. In addition, the recording material is liable to touch any of the members surrounding the transport path. Depending on an angle at which the medium touches such a member, there is a fear of bending or folding of a lead edge corner of the recording material (so-called "dog-ear").

SUMMARY OF THE INVENTION

The present invention has been made to address the above-described technical problems and to prevent the paper cockle and dog-ear of the recording material in the image forming apparatus in which the fixing device is installed on the recording material transport path from down to up against the force of gravity.

According to an aspect of the present invention, an image forming apparatus includes a recording material transporting path that extends in a direction from bottom to top of a body of the image forming apparatus and transports a recording material, a fixing device provided on the recording material transporting path, which includes a rotatable heating member that has an internal heat source and a rotatable pressure member that forms a nip area with the heating member by being located in contact with and pressed against the heating member, to nip the recording material for carrying out a fixing process, and an ejection guide member that guides a recording material ejected from the nip area to the outside of the image forming apparatus. The ejection guide member has a guide surface formed to intersect a tangent line of the heating member at the most downstream point of the nip area, and the guide surface intersects the tangent line at an obtuse angle.

BRIEF DESCRIPTION OF THE DRAWINGS

Embodiments of the present invention will be described in detail based on the following figures, wherein.

DETAILED DESCRIPTION OF THE INVENTION

An embodiment of the present invention will be described in detail hereinafter with reference to the accompanying drawings.

Figure 1:
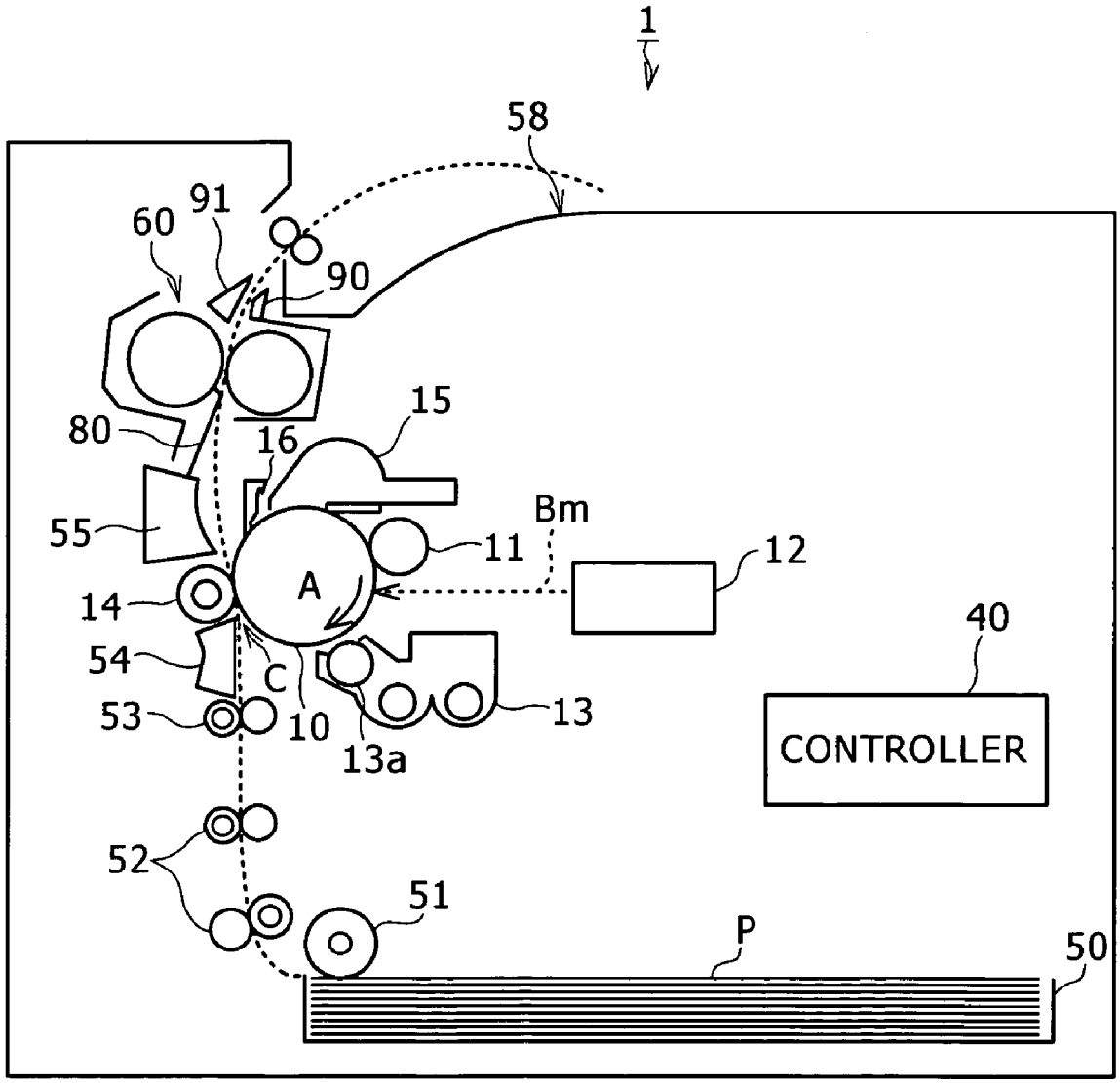
FIG. 1 is a schematic view showing an image forming apparatus.

FIG. 1 is a schematic view showing an image forming apparatus to which this embodiment is applied. The image forming apparatus 1 shown in FIG. 1 includes a photoreceptor drum 10 as an example of a toner image carrier rotating in the direction of arrow A and electrophotographic devices installed around the photoreceptor drum 10 such as a charger 11 to charge the photoreceptor drum 10, a laser exposure unit 12 (a light beam is denoted by Bm in the figure) by which flash exposure takes place to form an electrostatic latent image on the photoreceptor drum 10, a development unit 13 which houses toner and makes the electrostatic latent image visible by applying the toner to the latent image on the photoreceptor drum 10, a transfer roller 14 which transfers the toner image formed on the photoreceptor drum 10 to paper P which is a recording material, and a drum cleaner 15 by which residual toner on the photoreceptor drum 10 is removed. Moreover, the apparatus includes a fixing unit 60 which fixes an unfixed toner image transferred to the paper P and a controller 40 which controls the operations of the devices (units).

Furthermore, the image forming apparatus 1 of this embodiment includes, as elements forming a paper transport path, a paper tray 50 which houses sheets of paper P, a pickup roller 51 which draws one of the paper sheets P stacked in the paper tray 50 from the paper tray 50 at predetermined timing and transports the paper sheet P, transport rollers 52 which transport the paper sheet P drawn by the pickup roller 51, registration rollers 53 which feed the paper sheet P transported by the transport rollers 52 into the transfer roller 14 at a predetermined timing, an inlet chute 54 which guides the paper sheet P fed by the registration rollers 53 to a transfer nip area C, a transport guide 55 which transports the paper sheet P to the fixing unit 60 after the toner image transfer by the transfer roller 14, a fixing inlet guide 80 which guides the paper sheet P being transported onto which the toner image was transferred to the fixing unit 60, and paper eject guides 90, 91 as paper eject guide members to guide the paper sheet P ejected from the fixing unit 60 to an ejected paper stack 58.

In the configuration of the image forming apparatus 1 of this embodiment, the fixing unit 60 is located approximately vertically above the photoreceptor drum 10 and the paper tray 50 is located approximately vertically below the photoreceptor drum 10. A sheet of paper P fed from the paper tray 50 is transported on the transport path formed upward in an approximately vertical direction. At the transfer nip area C located along this transport path, a toner image formed on the photoreceptor drum 10 is transferred to the paper sheet P. The paper sheet P is further moved to the fixing unit 60 located above the transfer nip area C and a fixing process is performed on the paper.

The thus configured image forming apparatus 1 features a very short transport path of paper P and it is easy to expose a most part of the transport path only by opening one side of the image forming apparatus 1. Thus, the image forming time from paper feed to paper ejection can be shortened and the paper P can be transported more readily. In the event of a paper jam, the jammed paper P can be removed more easily. Moreover, another merit is that the image forming apparatus 1 can be designed to be installed in a smaller area.

Next, a basic image forming process of the image forming apparatus 1 according to this embodiment is described. In conjunction with the image forming apparatus 1 shown in FIG. 1, an image processing device not shown performs predetermined image processing on image data that is output from an image reading device (IIT) not shown, a personal computer (PC) not shown, or the like. The image processing device can perform a prescribed set of image processing such as shading correction, displacement correction, gamma correction, and image editing including edge erase, move editing, and the like on reflectance data that has been input to the image processing device. The thus processed image data is output to the laser exposure unit 12.

The laser exposure unit 12 applies a light beam Bm emitted from, for example, a semiconductor laser to the photoreceptor drum 10, according to the image data that has been input to laser exposure unit 12. After the surface of the photoreceptor drum 10 is charged by the charger 11 made up of a charging roller to a predetermined charging potential (e.g., −750V), the drum surface is scanned and exposed to the light beam from the laser exposure unit 12 and an electrostatic latent image is formed on the drum surface.

The formed electrostatic latent image is developed through a reversal development of negatively charged toner by the development unit 13. Specifically, by applying a developing bias of DC voltage or AC voltage superimposed with DC voltage from a power source not shown to a developer carrier (development sleeve) 13*a* that carries a developer in which toner particles with shape factors SF1 of 100 to 140 produced by, e.g., a polymerization method are mixed with carriers of magnetic particles, a development field is formed between the development unit 13 and the photoreceptor drum 10. Thereby, the toner is transferred from the development sleeve 13*a* to the imaging portions of the electrostatic latent image (exposed to the light) and the electrostatic latent image is visualized.

Next, as the toner image formed on the photoreceptor drum 10 is moved to the transfer nip area C where the photoreceptor drum 10 and the transfer roller 14 are brought into contact, a sheet of paper P of a given size is supplied from the paper tray 50 by rotation of the pickup roller 51 and put on the paper transport path in timing with the toner image movement to the transfer nip area C. The paper sheet P supplied by the pickup roller 51 is transported by the transport rollers 52 and come to the registration rollers 53. At the registration rollers 53, the paper sheet P is stopped and the registration rollers 53 rotate in timing with the motion of the photoreceptor drum 10 carrying the toner image. Thereby, the paper sheet P position and the toner image position are aligned and the paper sheet P is guided by the inlet chute 54 and moved to the transfer nip area C.

At the transfer nip area C, the transfer roller 14 is located in contact with and pressed against the photoreceptor drum 10. The transfer roller 14 is made up of a shaft and a sponge layer as an elastic layer bonded around the shaft. The shaft is a cylindrical metal bar made of iron, SUS, and the like. The sponge layer is made of a blended rubber of NBR, SBR, and EPDM mixed with a conductive agent such as carbon black and a cylindrical spongy roll with volume resistivity of $10^7$ to $10^9$ Ωcm.

Current-controlled constant current, for example, is supplied to the transfer roller 14 so that a transfer bias with polarity (positive) opposite to the polarity (negative) of the charges of the toner is steadily applied from a transfer power source (not shown). Thereby, charges with polarity opposite to the polarity of the charges of the toner on the photoreceptor drum 10 are applied from the transfer roller 14 to the paper sheet P. The transfer bias is set to be applied only when the region of an image formed on the photoreceptor drum 10 passes through the transfer nip area C and not to be applied when an inter-image region between image regions passes through the transfer nip area C.

The paper sheet P being transported in timing with the image is transported to the transfer nip area C and nipped between the photoreceptor drum 10 and the transfer roller 14. At this time, by applying the transfer bias from the transfer roller 14, the unfixed toner image carried on the photoreceptor drum 10 is electrostatically transferred to the paper sheet P.

Then, the paper sheet P onto which the toner image has been transferred electrostatically is peeled from the photoreceptor drum 10 by electrostatic adsorptive power from the transfer roller 14 and stiffness of the paper sheet P and transported to the fixing unit 60 located downstream of the transfer roller 14 in the paper sheet P transport direction. A peeling claw 16 is provided downstream of the transfer nip area C and near the surface of the photoreceptor drum 10 to separate the paper sheet P from the photoreceptor drum 10, if the paper sheet P remains sticking to the photoreceptor drum 10 without being peeled from the photoreceptor drum 10.

The unfixed toner image on the paper sheet P transported to the fixing unit 60 is fixed onto the paper sheet P by undergoing a fixing process with heat and pressure in the fixing unit 60. The paper sheet P having a fixed image formed thereon is transported to the ejected paper stack 58 provided in the ejection part of the image forming apparatus 1 and a series of image forming actions is complete.

Next, the configuration of the fixing unit 60 is described.

Figure 2:
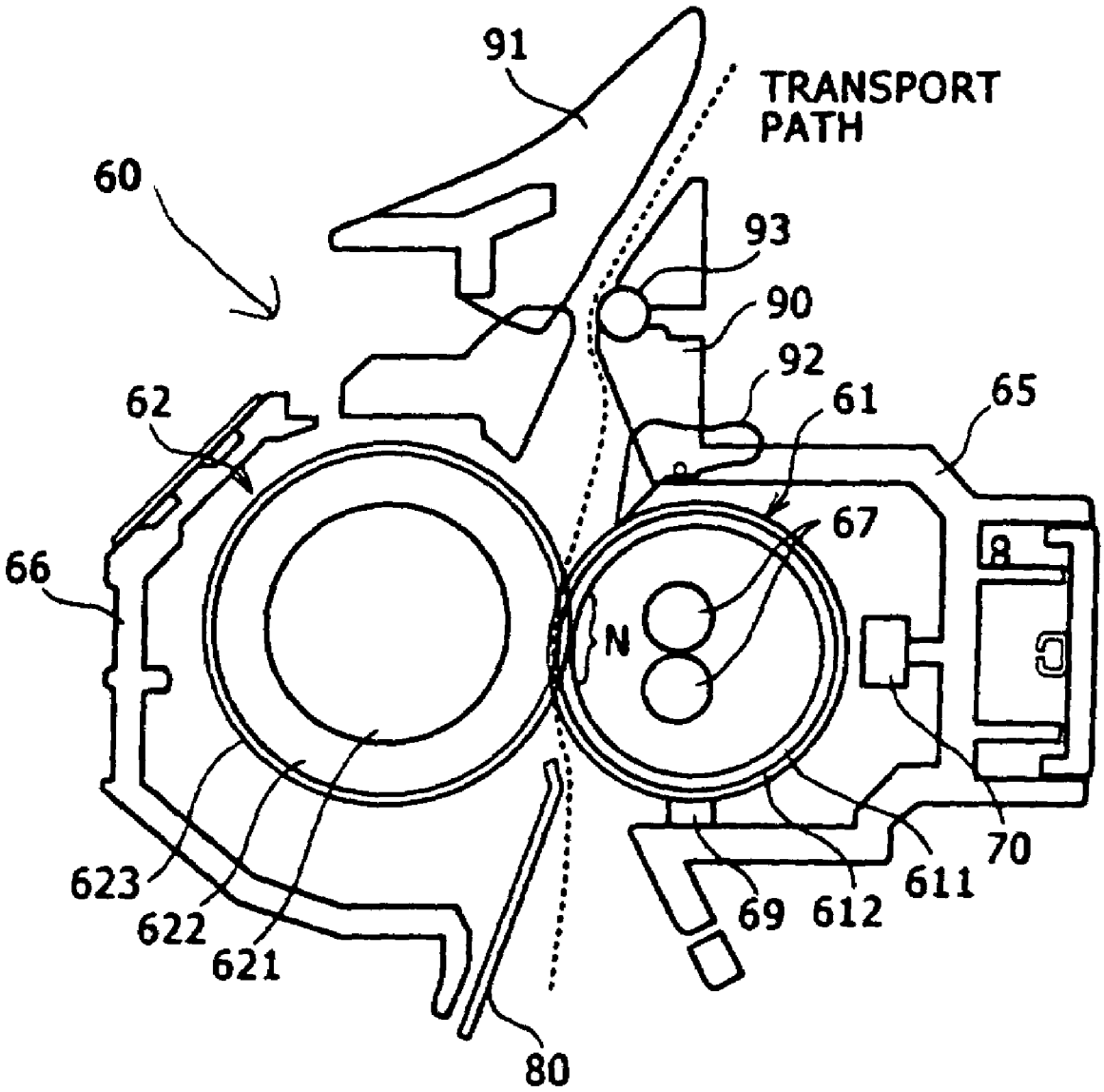
FIG. 2 is a cross sectional view showing a configuration of a fixing unit.

FIG. 2 is a cross sectional view showing the configuration of the fixing unit 60. As shown in FIG. 2, the fixing unit 60 is configured as a unit including a first casing 65 to rotatably support a fusing roller 61 and a second casing 66 to rotatably support a pressure roller 62. Both the casings 65 and 66 are installed such that a line connecting the center of the fusing roller 61 with the center of the pressure roller 62 is approximately horizontal in the image forming apparatus 1. The pressure roller 62 is pressed against the fusing roller 61 by an elastic body (not shown) made up of a coil spring or the like and a fixing nip area N is formed.

The fusing roller 61 is made up of a cylindrical core 611 and a release layer 612 coating the surface of the core 611. The core 611 has an outside diameter of, for example, 25 mm and a thickness of, for example, 1 to 1.5 mm. The core 611 is made of high thermal conductivity metal material, for example, iron, aluminum, SUS, and the like. For the release layer 612, a heat-resistive resin such as a silicon resin and a fluorocarbon resin can be used; the fluorocarbon resin is more suitable from a perspective of toner releasability and abrasion resistance. As the fluorocarbon resin, tetrafluoroethylene-perfluoroalkylvinylether copolymer (PFA), polytetrafluoroethylene (PTFE), tetrafluoroethylene-hexafluoropropylene copolymer (FEP), and the like can be used. The release layer 612 is formed to have a thickness of, for example, 5 to 100 μm Inside the fusing roller 61, for example, halogen heaters 67 with a rating of 600 W are installed to heat the fusing roller 61. A temperature sensor 69 is installed in contact with the surface of the fusing roller 61. The controller 40 of the image forming apparatus 1 performs on/off control of the halogen heaters 67, based on temperature measurement by the temperature sensor 69, and makes an adjustment to maintain the surface temperature of the fusing roller 61 at a predetermined temperature setting (e.g., 175° C.). Moreover, a thermostat 70 is installed near the fusing roller 61 inside the first casing 65 to prevent a fault of the fusing roller 61 due to overtemperature.

The pressure roller 62 is made up of a solid-core shaft 621 which is, for example, columnar, a heat-resistive elastic body layer 622 formed around the shaft 621, and a release layer 623 coating the surface of the heat-resistive elastic body layer 622. The shaft 621 is made of, for example, iron or aluminum and may be hollow. The heat-resistive elastic body layer 622 is formed of a heat-resistive material with hardness of 45° (Asker C), for example, a silicon sponge or silicon rubber. The heat-resistive elastic body layer 622 is formed to have a thickness of 6 mm or more to provide an approximately constant nip width when the pressure roller 62 is pressed against the fusing roller 61. A suitable range of the thickness of the heat-resistive elastic body layer 622 is 6 to 8 mm. The release layer 623 is made of, for example, PFA having good toner releasability and abrasion resistance. . A suitable range of the thickness of the release layer 623 is, for example, 30 to 100 μm.

The paper transport path is formed upstream and downstream of the fixing nip area N formed between the fusing roller 61 and the pressure roller 62 and a sheet of paper P is transported from down to up. Upstream of the fixing nip area N (paper feed side), the fixing inlet guide 80 made up of, a plate metal which forms a part of the paper transport path is installed. Downstream of the fixing nip area N (paper ejection side), the paper eject guides 90, 91 which form a part of the paper transport path are installed. The paper eject guides 90, 91 are formed of multiple ribs and installed on the side of the first casing 65 and on the side of the second casing 66, respectively, to allow the sheet of paper P to pass between the paper eject guide 90 and the paper eject guide 91. Moreover, at the vertex of the paper eject guide 90 facing toward the paper eject guide 91, a rotating roller 93 is installed to avoid abrasion of the paper sheet P passing between the paper eject guide 90 and the paper eject guide 91, thus implementing smooth paper transport.

Downstream of and near the fixing nip area N, plural peeling claws 92 are arranged on the first casing 65 in an axial direction (across the width of paper) of the fusing roller 61. These peeling claws 92 are forced toward the fusing roller 61 with a small force so as not to damage the surface of the fusing roller 61 and arranged to peel a paper sheet P that is going to wind around the fusing roller 61 with their tips being pressed against the surface of the fusing roller 61.

Figure 3:
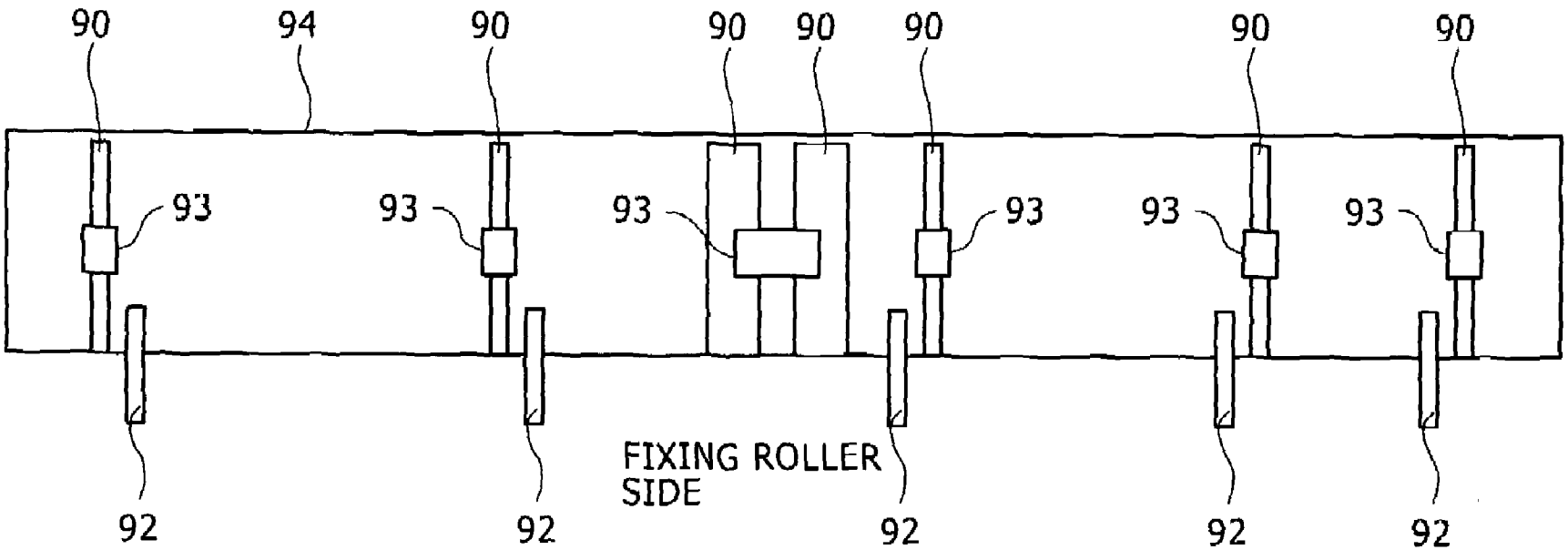
FIG. 3 is a view showing paper eject guides and peeling claws arranged across the set width of paper.

FIG. 3 is a view showing paper eject guides 90 and peeling claws 92 arranged across the set width of paper. As shown in FIG. 3, the paper eject guides 90 and peeling claws 92 are arranged roughly alternately at predetermined intervals in a paper eject guide holder 94. Rotating rollers 93 are installed at the respective vertexes of the paper eject guides 90. Through this arrangement, the paper sheet P passed across the fixing nip area N is transported to the ejected paper stack 58.

Next, the arrangement of components surrounding the transport path is described.

Figure 4:
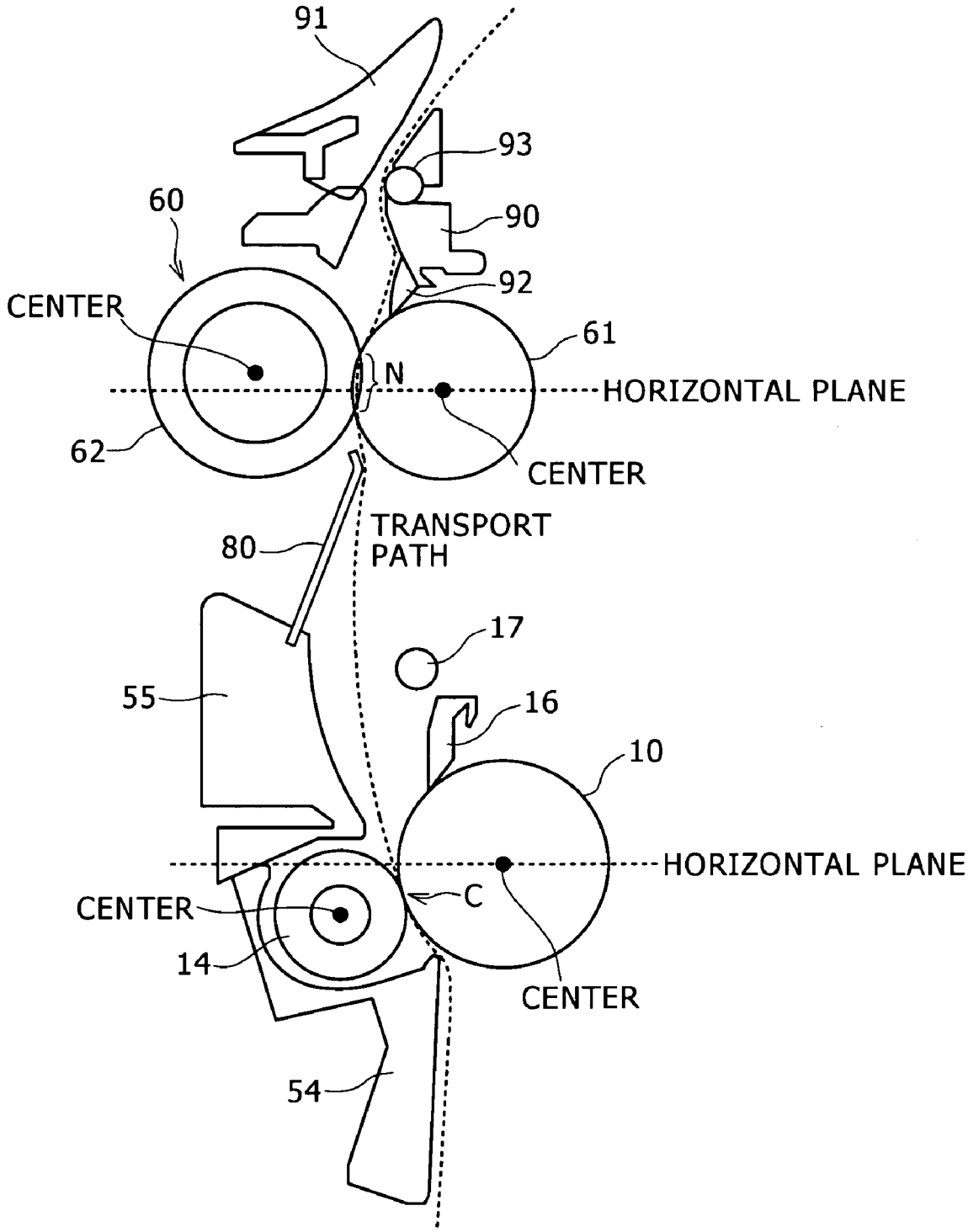
FIG. 4 is a view to explain arrangements of components surrounding the transport path.

FIG. 4 is a view to explain the arrangement of the components surrounding the transport path. First, positional relationship between the transfer roller 14 and the photoreceptor drum 10 is explained. In the image forming apparatus 1 of this embodiment, the paper transport path is formed from down to up in an approximately vertical direction. At the exit (downstream) of the transfer nip area C where the photoreceptor drum 10 and the transfer roller 14 are brought into contact, if the paper sheet P is ejected leaning toward the side of the photoreceptor drum 10 from the vertical direction, then the paper sheet P will be transported with its surface having the toner image transferred thereto leaning toward the side of the photoreceptor drum 10. In that event, the toner image touches the members arranged in the image forming apparatus 1 and is disturbed, resulting in an image defect. Thus, as shown in FIG. 4, the position where the photoreceptor drum 10 and the transfer roller 14 are brought into contact is set slightly below a horizontal plane passing through the center of the photoreceptor drum 10. By this arrangement, the paper sheet P that has passed across the transfer nip area C is ejected leaning toward the side of the transfer roller 14 from the vertical direction and, therefore, the toner image on the paper sheet P is restrained from touching the members such as the peeling claw 16 and a start wheel 17.

Next, positional relationship between the fusing roller 61 and the pressure roller 62 in the fixing unit 60 is explained. In the fixing unit 60, the fusing roller casing 65 and the pressure roller casing 66 are installed such that the line connecting the center of the fusing roller 61 with the center of the pressure roller 62 is approximately horizontal in the image forming apparatus 1, as described above. However, when the paper sheet P ejected from the fixing unit 60 is allowed to pass between the paper eject guide 90 and the paper eject guide 91 and transported to the ejected paper stack 58, if the curvature radius of the transport path formed between the paper eject guide 90 and the paper eject guide 91 is small (forming a steep curve), the paper sheet P is liable to curl immediately after being heated by the fixing unit 60. Thus, as shown in FIG. 4, the pressure roller 62 is installed slightly above a horizontal plane passing through the center of the fusing roller 61 in the fixing unit 60. By this arrangement, the paper sheet P passed across the fixing nip area N is ejected leaning toward the side of the fusing roller 61, in other words, the side of the ejected paper stack 58 from the vertical direction. Consequently, between the paper eject guide 90 and the paper eject guide 91, the transport path can be formed with a large curvature radius and the paper sheet P can be restrained from curling.

Moreover, positional relationship in the horizontal direction between the transfer nip area C between the photoreceptor drum 10 and the transfer roller 14 and the fixing nip area N where the fusing roller 61 is pressed against the pressure roller 62 in the fixing unit 60 is explained. In the horizontal direction, if the fixing nip area N is positioned nearer to the center of the photoreceptor drum 10 inward from the transfer nip area C, when the paper sheet P that has passed across the transfer nip area C is transported to the fixing unit 60, it is needed to bend the paper path toward the fixing nip area N. In this arrangement, it becomes easy for the paper sheet P to touch the photoreceptor drum 10 and this is undesirable. On the other hand, in the horizontal direction, the fixing nip area N is positioned nearer to the center of the transfer roller 14 outward from the transfer nip area C, it is needed to transport the paper sheet P while bringing the paper sheet P in contact with the transfer roller 14 longer to ensure stable transportation of the paper sheet P. In this case, the area where the image forming apparatus 1 is installed becomes larger. In view of the above, the horizontal position of the fixing nip area N may be virtually the same as the horizontal position of the transfer nip area C or somewhat shifted toward the transfer roller side from the position of the transfer nip area C.

By this placement of the photoreceptor drum 10 and the transfer roller 14 and the placement of the fusing roller 61 and the pressure roller 62 in the fixing unit 60, the paper transport path from the transfer nip area C to fixing nip area N is slightly bent away from the photoreceptor drum 10 downstream of the exit of the transfer nip area C and slightly bent to the photoreceptor drum side before entering the fixing unit 60. Through this arrangement, the paper transport path from the transfer nip area C to the fixing nip area N draws a gently curved line outward from the vertical direction toward the transfer roller side (pressure roller side), as shown in FIG. 4, which makes it hard for the paper sheet P surface carrying the toner image to touch the members installed surrounding the transport path.

In particular, in the image forming apparatus 1 of this embodiment, the distance from the transfer nip area C to the fixing nip area N is shorter than a lengthwise dimension of, for example, A4 size paper sheet P and, therefore, it might occur that the lead edge of a paper sheet P enters the fixing nip area N while its trail edge is still nipped by the transfer nip area C. To avoid a transfer deviation or defect caused by a paper sheet P whose trail edge is nipped by the transfer nip area C pulled by the nip of its lead edge in the fixing nip area N, the roller speed in the fixing unit 60 is set somewhat slower than the roller speed in the transfer nip area C. Thereby, the paper sheet P on the transport path from the transfer nip area C to the fixing nip area N becomes slack slightly. Therefore, to make it hard for the paper sheet P to touch the members installed surrounding the transport path, the paper transport path is formed to have a gently curved line outward from the vertical direction toward the transfer roller side (pressure roller side) as described above.

Next, after the paper sheet P is transported from the transfer nip area C to the fixing unit 60 on the above-described transport path and the fixing process is performed in the fixing unit 60, a transport path along which the paper sheet P is ejected from the fixing unit 60 is explained.

Figure 5:
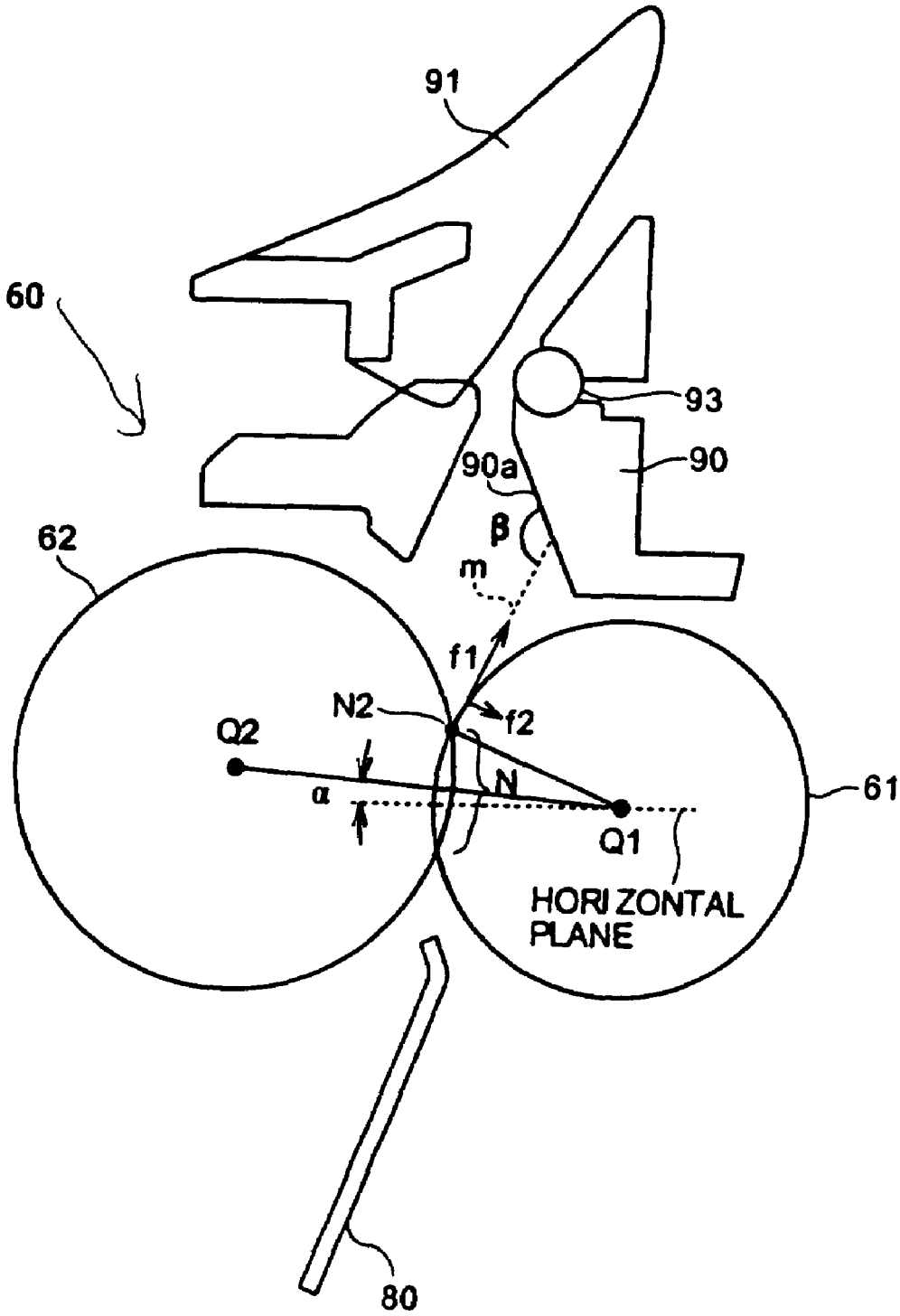
FIG. 5 is a view to explain a paper eject guide located on the ejection side of the fixing unit.

FIG. 5 is a view to explain the paper eject guide 90 located on the ejection side of the fixing unit 60. As described above, the paper eject guides 90, 91 formed of ribs are installed on the ejection side of the fixing unit 60. The paper sheet P ejected from the fixing unit 60 is guided to pass between the paper eject guide 90 and the paper eject guide 91 and transported to the ejected paper stack 58 provided in the ejection part of the image forming apparatus 1 (see FIG. 1 also). At this time, to prevent wave-like flexure (so-called "paper cockle") toward the forward direction and bending or folding of a lead edge corner (so-called "dog-ear") of the paper sheet P ejected from the fixing unit 60, the paper eject guide 90 of this embodiment is designed as follows. A transport-path-side guide surface 90*a* of the paper eject guide 90 is formed to intersect a tangent line m on the surface of the fusing roller 61 at an exit point N2 from the fixing nip area N at an obtuse angle β near the fusing roller 61.

Now, a mechanism of producing paper cockle on the paper sheet P ejected from the fixing unit 60 is described. First, force f1 that pushes the paper sheet P along the tangent line m on the surface of the fusing roller 61 at the exit point N2 from the fixing nip area N is strongly exerted on the paper sheet P ejected from the fixing unit 60, produced by the fusing roller 61 and the pressure roller 62 that rotate while being pressed against each other. This is an experimentally proven event and considered to be produced as a result of balancing the adsorptive power of the fusing roller 61 and the adsorptive power of the pressure roller 62 on the paper sheet P, as the fusing roller 61 and the pressure roller 62 rotate, pressed against each other in the fixing nip area N. Because the toner image is carried on the surface of the paper sheet P brought in contact with the fusing roller 61, adherence is exerted between the toner image and the surface of the fusing roller 61. Thereby, force f2 toward the surface of the fusing roller 61 is also exerted on the paper sheet P. Because this force f2 toward the surface of the fusing roller 61 is the adherence between the toner image and the surface of the fusing roller 61, it changes depending on the ratio of the area occupied by the toner image on the surface of the paper sheet P. Because the direction of gravity is approximately opposite to the paper sheet P transport direction, its effect as force exercised on the paper sheet P is extremely small.

Under the condition where these forces are exercised, the force fl pushing the paper sheet P out of the fixing nip area N is mainly exerted on the paper sheet P ejected from the fixing unit 60. However, by action of the force f2 toward the surface of the fusing roller 61, which changes depending on the amount of the toner forming the image, the direction in which the paper sheet P moves is deflected toward the fusing roller surface from the direction of the tangent line m on the surface of the fusing roller 61. Specifically, when the force f2 exerted on the fusing roller surface is relatively strong, the paper sheet P is oriented toward the fusing roller surface. When the force f2 exerted on the fusing roller surface is relatively weak, the paper sheet P is oriented toward the direction of the tangent line m. Because of such unstable behavior of the paper sheet P, paper cockle is considered to occur on the paper sheet P.

In the paper eject guide 90 of this embodiment, the transport-path-side guide surface 90*a* of the paper eject guide 90 is formed to intersect the tangent line m on the surface of the fusing roller 61 at the exit point N2 from the fixing nip area N at an obtuse angle β near the fusing roller 61.

As described above, in the fixing unit 60, the center Q2 of the pressure roller 62 is positioned slightly above the horizontal plane passing through the center Q1 of the fusing roller 61 by an angle of α (α>0). Accordingly, the tangent line m on the surface of the fusing roller 61 at the exit point N2 from the fixing nip area N is set tilting toward the fusing roller 61. Thus, the paper eject guide 90 is installed on the side of and near the fusing roller 61 and the guide surface 90*a* is formed to intersect the tangent line m on the surface of the fusing roller 61 at an obtuse angle β, so that the force f1 that is strongly exerted on the paper sheet P ejected from the fixing unit 60 to push the paper sheet P along the tangent line m will strongly push the paper sheet P against the guide surface 90*a* of the paper eject guide 90. Thereby, the paper sheet P ejected from the fixing unit 60 will be strongly supported by both the fixing nip area N and the guide surface 90*a* of the paper eject guide 90.

Because the paper sheet P ejected from the fixing unit 60 is thus strongly supported by the fixing nip area N and the guide surface 90*a* of the paper eject guide 90, even if the force f2 toward the fusing roller surface is exerted on the paper sheet P when the paper sheet P is ejected from the fixing unit 60, the supporting force of the fixing nip area N and the reactive force from the guide surface 90*a* of the paper eject guide 90 produce force that counteracts the force f2 on the paper sheet P. Consequently, the direction in which the paper sheet P moves is made stable and deflection from the direction of the tangent line m on the surface of the fusing roller 61 to the fusing roller 61 is made stable, and paper cockle on the paper sheet P is prevented.

Because the tangent line m intersects the guide surface 90*a* of the paper eject guide 90 at an obtuse angle β, after the guide surface 90*a* contacts the paper eject guide 90, the paper sheet P is transported smoothly along the guide surface 90*a*. Because an unwanted force that checks the paper sheet P in its course is not exerted on the lead edge of the paper sheet P, the dog-ear can be prevented in both lead edge comers of the paper sheet P.

By the way, in this configuration, when the force f1 that pushes the paper along the tangent line m strongly pushes the paper sheet P against the guide surface 90*a* of the paper eject guide 90, transmission of the force f1 pushing the paper along the tangent line m to the guide surface 90*a* of the paper eject guide 90 depends on the rigidity (so-called "stiffness") of the paper sheet P. Therefore, to keep the rigidity of the paper sheet P strong, the distance from the exit point N2 of the fixing nip area N to the guide surface 90*a* of the paper eject guide 90 may be set short. Thus, the guide surface 90*a* of the paper eject guide 90 is located near the fusing roller 61. Specifically, the guide surface 90*a* of the paper eject guide 90 is set up so that the intersection with the tangent line m is positioned near the pressure roller 62 in relation to the vertical line passing through the center Q1 of the fusing roller 61.

Next, setting the angle of the guide surface 90*a* of the paper eject guide 90 in relation with the peeling claw 92 is described.

Figure 6:
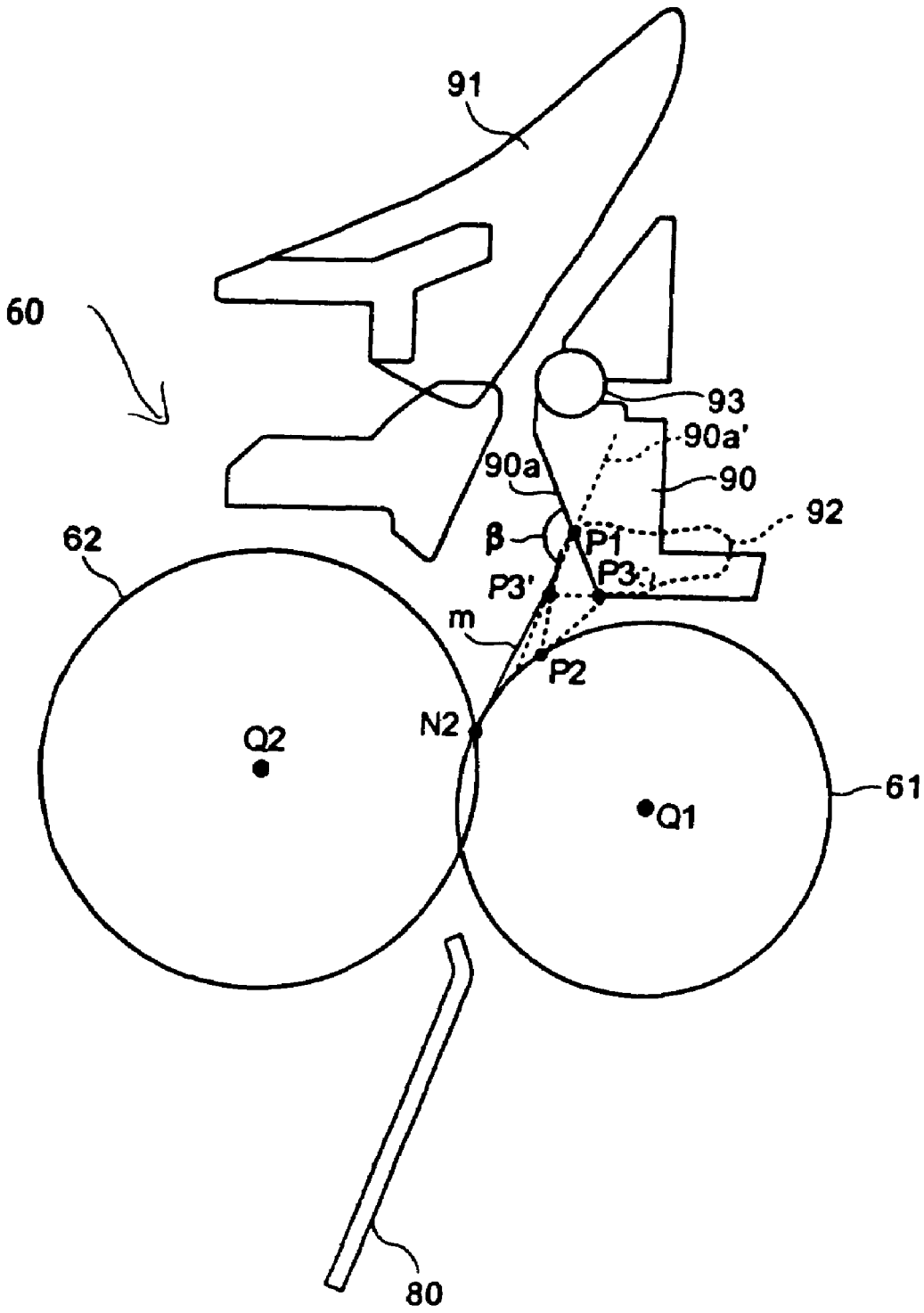
FIG. 6 is a view to explain a limit of setting a pressure-roller-side of paper eject guide surface in relation with the peeling claw.
Figure 7:
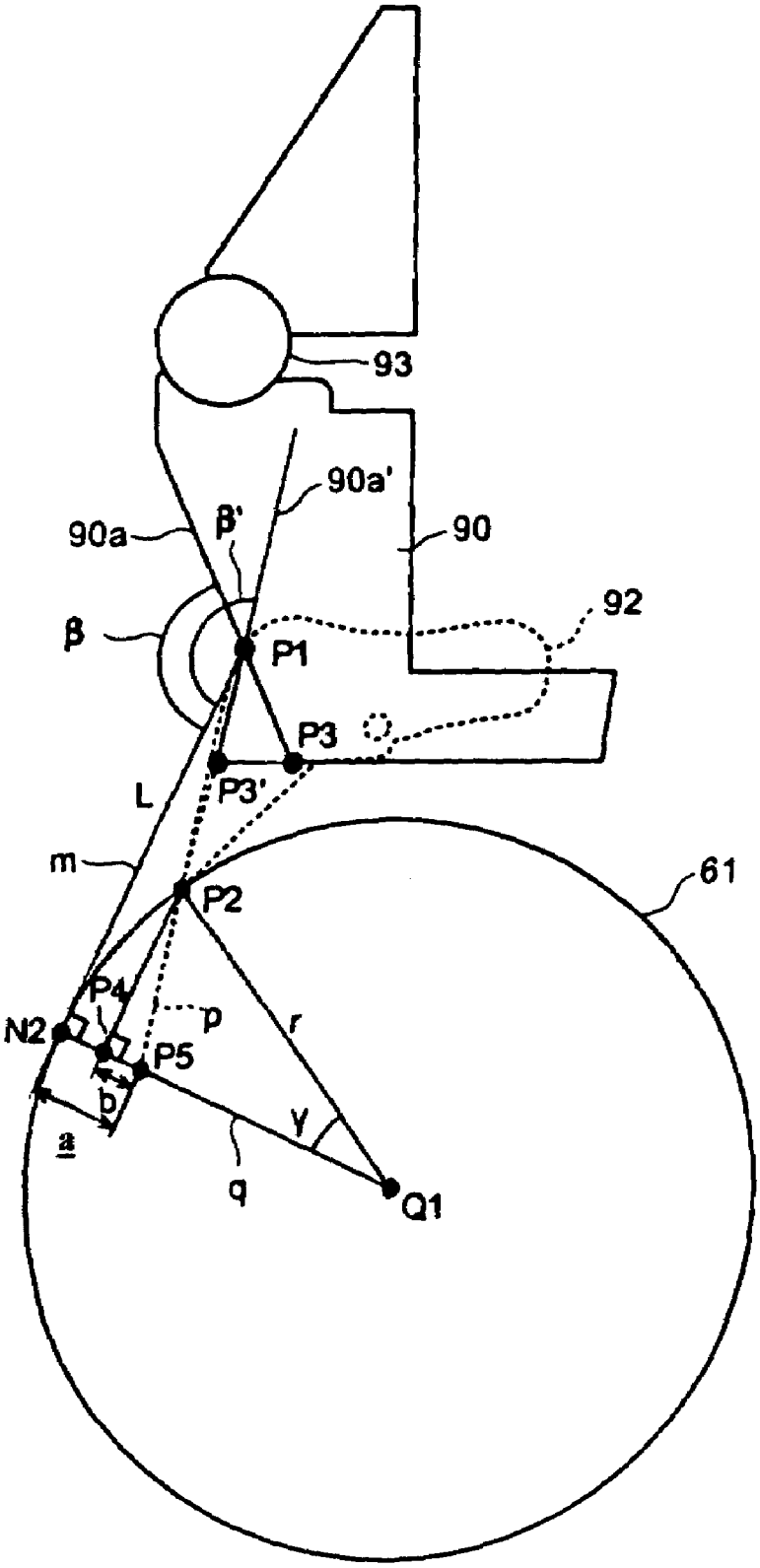
FIG. 7 is a view showing positional relationship of a fusing roller, paper eject guide, and peeling claw to determine an upper limit of the angle β of intersection.

FIG. 6 is a view to explain a range of setting of the guide surface 90*a* of the paper eject guide 90 in relation with peeling claw 92. Now, let us consider an instance where the bottom end P3 (the end near to the fusing roller 61) of the guide surface 90a of the paper eject guide 90 is set to protrude toward the pressure roller 62 and a point at which extension of the guide surface 90*a* toward the fusing roller 61 interests the surface of the fusing roller 61 is set near the pressure roller 62 in relation to a point P2 where the peeling claw 92 touches the fusing roller surface (at the left-hand side of the point P2). In this instance, the bottom end P3' of the guide surface 90*a* of the paper eject guide 90 is positioned closer to the pressure roller 62 than the peeling claw 92. When the peeling claw 92 peels the paper sheet P that is going to wind around the fusing roller 61, the peeled paper sheet P is guided by the peeling claw 92 and hits against the bottom end P3'. As a result, a dog-ear may occur by the bottom end P3' or a paper jam may occur in the worst case. Therefore, it is required to set the bottom end P3 of the guide surface 90*a* of the paper eject guide 90 in an inner position than the peeling claw 92 over the fusing roller 61 (at the right-hand side of the point P2). In other words, it is needed to set the angle β of intersection at which the guide surface 90*a* of the paper eject guide 90 intersects the tangent line m smaller than a predetermined value Determining an upper limit β' of the angle of β intersection is described below. FIG. 7 is a view showing positional relationship of the fusing roller 61, paper eject guide 90, and peeling claw 92 to determine the upper limit β' of the angle β of intersection. In FIG. 7: P1 is a point at which the tangent line m on the surface of the fusing roller 61 at the exit point N2 from the fixing nip area N contacts the guide surface 90*a* of the paper eject guide 90; P5 is a point at which an extension line p of the guide surface 90*a* (which is set as denoted by 90*a'* in this case) passes through a point P2 and intersects a line segment q connecting the exit point N2 and the center Q1 of the fusing roller 61, if the bottom end P3 of the guide surface 90*a* is set to protrude to the position of the peeling claw 92 (the bottom end P3 is set in a position P3'); and P4 is a point at which a line from the point P2, where the peeling claw 92 touches the surface of the fusing roller 61, perpendicularly intersects the line segment q connecting the exit point N2 with the center Q1 of the fusing roller 61; β' is the angle of intersection of the tangent line m with the guide surface 90*a* of the paper eject guide 90, if the bottom end P3 of the guide surface 90*a* is set to protrude to the position of the peeling claw 92; L is the distance from the exit point N2 to the point P1; r is the radius of the fusing roller 61; a is the length of a line segment connecting the exit point N2 with the point P5; b is the length of a line segment connecting the point P4 and the point P5; γ is an angle formed between the exit point N2 and the point P2 from the center Q1 of the fusing roller 61.

In the above setting, a condition of avoiding that the bottom end P3 of the guide surface 906*a* protrudes toward the pressure roller 62, exceeding the position of the peeling claw 92, is that the point at which the extension line p of the guide surface 90*a* intersects the line segment q connecting the exit point N2 with the center Q1 of the fusing roller 61 is positioned closer to the center Q1 of the fusing roller 61 than the point P5.

First, from ΔP1, N2, P5, we get:

$$a=L\cdot(180°-\beta') \quad (1)$$

Then, from ΔQ1, P2, P4 and ·ΔP2, P4, P5, we get:

$$b=r\cdot\sin\gamma\times\tan(180°-\beta') \quad (2)$$

and $$a=r-(r\cdot\cos\gamma-b) \quad (3)$$

Therefore, from equations (2) and (3), we get:

$$a=r-(r\cdot\cos\gamma-r\cdot\sin\gamma c\tan(180°-\beta')) \quad (4)$$

From equations (1) and (4), we get:

$$L\cdot\tan(180°-\beta'))$$

$$=r-(r\cdot\cos\gamma-r\cdot\sin\gamma\times\tan(180°-\beta')) \quad (5)$$

Therefore, from equation (5), we get:

$$\tan(180°-\beta')=r(1-\cos\gamma)/(L-r\cdot\sin\gamma) \quad (6)$$

Then, the upper limit β' of the angle β of intersection can be obtained.

Accordingly, the guide surface 906*a* of the paper eject guide 90 is set so that the angle β of intersection of the tangent line m with the guide surface 90*a* of the paper eject guide 90 fulfills the following constraint from equation (6):

$$\tan(180°-\beta)\geqq r(L-\cos\gamma)/(L-r\cdot\sin\gamma) \quad (7)$$

where β>90°

Consequently, it does not occur that the bottom end P3 of the guide surface 90*a* protrudes toward the pressure roller 62, exceeding the position of the peeling claw 92. The dog-ear and paper jam at the bottom end P3 can be prevented.

As described above, in the image forming apparatus 1 of this embodiment, the center Q2 of the pressure roller 62 is positioned slightly above the horizontal plane passing through the center Q1 of the fusing roller 61 by an angle of α(α>0) in the fixing unit 60. Moreover, in the paper eject guide 90, the transport-path-side guide surface 90*a* of the paper eject guide 90 is formed to intersect the tangent line m on the surface of the fusing roller 61 at the exit point N2 from the fixing nip area N at an obtuse angle near the fusing roller 61. By this arrangement, the paper sheet P ejected from the fixing unit 60 is strongly supported by the fixing nip area N and the guide surface 90*a* of the paper eject guide 90. Therefore, even if the force f2 toward the fusing roller surface is exerted on the paper sheet P when the sheet is ejected from the fixing unit 60, the supporting force of the fixing nip area N and the reactive force from the guide surface 906*a* of the paper eject guide 90 produce a force that counteracts the force f2 on the paper sheet P. Consequently, the direction in which the paper sheet P moves is made stable and deflection from the direction of the tangent line m on the surface of the fusing roller 61 to the fusing roller 61 is made stable, and paper cockle on the paper P is prevented.

Because the tangent line m intersects the guide surface 90*a* of the paper eject guide 90 at an obtuse angle, after the guide surface 90*a* contacts the paper eject guide 90, the paper sheet P is transported smoothly along the guide surface 906*a*. Because an unwanted force that checks the paper sheet P in its course is not exerted on the lead edge of the paper sheet P, the dog-ear can be prevented in both lead edge corners of the paper sheet P.

Furthermore, the guide surface 90*a* of the paper eject guide 90 is set so that the angle β of intersection of the tangent line m with the guide surface 90*a* of the paper eject guide 90 fulfills the following constraint:

$$\tan(180°-\beta)\geqq r(1-\cos\gamma)/(L-r\cdot\sin\gamma)$$

where β>90°

Consequently, it does not occur that the bottom end P3 of the guide surface 90*a* protrudes toward the pressure roller 62, exceeding the position of the peeling claw 92. The dog-ear and paper jam at the bottom end P3 can be prevented.

Examples of application of the present invention involve application to an electrophotographic copying machine, printer, facsimile, and a multifunction machine including their functions.

As described above, an image forming apparatus according to an aspect of the present invention includes a recording material transporting path that extends in a direction from bottom to top of a body of the image forming apparatus and transports a recording material, a fixing device provided on the recording material transporting path, which includes a rotatable heating member that has an internal heat source and a rotatable pressure member that forms a nip area with the heating member by being located in contact with and pressed against the heating member, to nip the recording material for carrying out a fixing process, and an ejection guide member that guides a recording material ejected from the nip area to the outside of the image forming apparatus. The ejection guide member has a guide surface formed to intersect a tangent line of the heating member at the most downstream point of the nip area, and the guide surface intersects the tangent line at an obtuse angle.

The pressure member may be located with its center positioned vertically above a horizontal plane passing through a center of the heating member. The image forming apparatus may further include a peeling member to peel the recording material from the heating member. The guide surface of the ejection guide member may be set so that an angle β of intersection of the guide surface with the tangent line satisfies the following expression:

$$\tan(180°-\beta)\geqq r(1-\cos\gamma)/(L-r\cdot\sin\gamma)$$

where, γ is an angle formed between the most downstream point of the nip area for fixing and a point where the peeling member touches the surface of the heating member from the center of the heating member, r is a radius of the heating member, and L is a distance between the most downstream point of the fixing nip area and intersection of the guide surface with the tangent line. Moreover, the guide surface of the ejection guide member may be formed so that the intersection of the guide surface with the tangent line is positioned near the pressure member in relation to a vertical line passing through the center of the heating member. The ejection guide member may be formed in a rib shape.

An image forming apparatus according to another aspect of the present invention includes a recording material transporting path that extends in a direction from bottom to top of a body of the image forming apparatus and transports a recording material, a fixing device provided on the recording material transporting path, including a rotatable fusing roller that has an internal heat source and a rotatable pressure roller, whose center is positioned vertically above a horizontal plane passing through a center of the fusing roller, that forms a nip area with the fusing roller by being located in contact with and pressed against the fusing roller to nip the recording material for carrying out a fixing process, and plural ribs each of which has a guide surface formed to intersect, at a position downstream and near the nip area, a tangent line of the fusing roller at the most downstream point of the nip area, the guide surface intersecting the target angle at an obtuse angle.

The image forming apparatus may further include a peeling member to peel the recording material from the fusing roller, wherein a bottom end of the guide surface of the rib may be positioned near the fusing roller in relation to a pressure-member-side surface of the peeling member. The plural ribs may be arranged at predetermined intervals in a width direction of the recording material. Moreover, a rotating roller may be installed on the rib downstream of the intersection of the rib with the tangent line. In addition, the rib may guide the recording material to the outside of the apparatus while supporting the recording material.

According to another aspect of the present invention, an image forming apparatus includes a recording material transporting path that extends in a direction from bottom to top of a body of the image forming apparatus and transports a recording material, a fixing device provided on the recording material transporting path, including a rotatable heating member that has an internal heat source and a rotatable pressure member that forms a nip area with the heating member by being located in contact with and pressed against the heating member, to nip the recording material for carrying out a fixing process, and an ejection guide member that guides the recording material ejected from the nip area to the outside of the image forming apparatus. The pressure member is located with its center positioned vertically above a horizontal plane passing through the center of the heating member.

According to the aspects of the invention, in the image forming apparatus in which the fixing device is installed on the recording material transport path from down to up against the force of gravity, paper cockle and dog-ear defects of recording material can be prevented. Thereby, flatness of the recording material is maintained after an image is fixed onto the recording material and a high-quality fixed image can be formed.

The present invention may be embodied in other specific forms without departing from its spirit or characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

The entire disclosure of Japanese Patent Application No. 2004-320500 filed on Nov. 4, 2004 including specification, claims, drawings and abstract is incorporated herein by reference in its entirety.

What is claimed is:

1. An image forming apparatus comprising:

a recording material transporting path that extends in a direction from bottom to top of a body of the image forming apparatus and transports a recording material;

a fixing device provided on the recording material transporting path, comprising a rotatable heating member that has an internal heat source and a rotatable pressure member that forms a nip area with the heating member by being located in contact with and pressed against the heating member, to nip the recording material for carrying out a fixing process; and an ejection guide member that guides a recording material ejected from the nip area to the outside of the image forming apparatus, wherein the ejection guide member has a guide surface formed to intersect a tangent line of the heating member at the most downstream point of the nip area, the guide surface intersecting the tangent line at an obtuse angle.

2. The image forming apparatus according to claim 1, wherein the pressure member is located with its center positioned approximately vertically above a horizontal plane passing through the center of the heating member.

3. The image forming apparatus according to claim 1, further comprising a peeling member that peels the recording material from the heating member, wherein the guide surface of the ejection guide member is set so that an angle β of intersection of the guide surface with the tangent line satisfies the following expression:

$$\tan(180°-\beta) \geqq r(1-\cos\gamma)/(L-r\cdot\sin\gamma)$$

where, γ is an angle formed between the most downstream point of the nip area for fixing and a point where the peeling member touches the surface of the heating member from the center of the heating member, r is a radius of the heating member, and L is a distance between the most downstream point of the nip area for fixing and the intersection of the guide surface with the tangent line.

4. The image forming apparatus according to claim 1, wherein the guide surface of the ejection guide member is formed so that the intersection of the guide surface with the tangent line is positioned near the pressure member in relation to a vertical line passing through the center of the heating member.

5. The image forming apparatus according to claim 1, wherein the ejection guide member is formed in a rib shape.

6. An image forming apparatus comprising:

a recording material transporting path that extends in a direction from bottom to top of a body of the image forming apparatus and transports a recording material;

a fixing device provided on the recording material transporting path, comprising a rotatable fusing roller that has an internal heat source and a rotatable pressure roller, whose center is positioned approximately vertically above a horizontal plane passing through a center of the fusing roller, that forms a nip area with the fusing roller by being located in contact with and pressed against the fusing roller to nip the recording material for carrying out a fixing process; and a plurality of ribs each of which has a guide surface formed to intersect, at a position downstream and near the nip area, a tangent line of the fusing roller at the most downstream point of the nip area, the guide surface intersecting the tangent line at an obtuse angle.

7. The image forming apparatus according to claim 6, further comprising a peeling member that peels the recording material from the fusing roller, wherein a bottom end of the guide surface of the rib is positioned near the fusing roller in relation to a pressure-roller-side surface of the peeling member.

8. The image forming apparatus according to claim 6, wherein the plurality of ribs are arranged at predetermined intervals in a width direction of the recording material.

9. The image forming apparatus according to claim 6, wherein a rotating roller is installed on each of the plurality of ribs downstream of the intersection of the rib with the tangent line.

10. The image forming apparatus according to claim 6, wherein the plurality of ribs guide the recording material to the outside of the image forming apparatus while supporting the recording material.

11. An image forming apparatus comprising:

a recording material transporting path that extends in a direction from bottom to top of a body of the image forming apparatus and transports a recording material;

a fixing device provided on the recording material transporting path, comprising a rotatable heating member that has an internal heat source and a rotatable pressure member that forms a nip area with the heating member by being located in contact with and pressed against the heating member, to nip the recording material for carrying out a fixing process; and a plurality of ribs each of which has a guide surface formed to intersect, at a position downstream and near the nip area, a tangent line of the fusing roller at the most downstream point of the nip area, the guide surface intersecting the tangent line at an obtuse angle.

* * * * *